United States Patent [19]

Holstein

[11] Patent Number: 4,459,952

[45] Date of Patent: Jul. 17, 1984

[54] CYLINDER DEACTIVATOR DEVICE FOR DIESEL ENGINES

[76] Inventor: Edward Holstein, 284 Rouge Rd., Winnipeg, Manitoba, Canada, R3K 1K2

[21] Appl. No.: 402,531

[22] Filed: Jul. 28, 1982

[51] Int. Cl.[3] ..... F02M 63/02

[52] U.S. Cl. ..... 123/198 F; 123/450

[58] Field of Search ..... 123/198 F, 450, 481

[56] References Cited

U.S. PATENT DOCUMENTS

| | | | |
|---|---|---|---|
| 1,967,101 | 7/1934 | Rassbach et al. | 123/198 F |
| 2,875,742 | 3/1959 | Dolza | 123/198 F |
| 3,741,685 | 6/1973 | Simko | 123/198 F |
| 3,752,138 | 8/1973 | Gaines | 123/450 |
| 3,815,563 | 6/1974 | Stinsa | 123/198 F |
| 3,902,472 | 9/1975 | Baugelin | 123/198 F |
| 3,929,113 | 12/1975 | Kawase et al. | 123/198 F |
| 3,974,810 | 8/1976 | Yajima | 123/198 F |
| 4,071,010 | 1/1978 | Miller | 123/198 F |
| 4,150,651 | 4/1979 | Wade et al. | 123/198 F |
| 4,297,979 | 11/1981 | Kamleitner | 123/198 F |

*Primary Examiner*—Ira S. Lazarus

*Attorney, Agent, or Firm*—Stanley G. Ade

[57] ABSTRACT

A cylinder deactivating device for diesel engines includes a rotary valve assembly operatively connected selectively to half of the cylinders so that half of the cylinders can be cutout when desired. The preferred embodiment includes a pair of separate rotary elements in the valve assembly which can be operated individually so that in an eight cylinder engine for example, it may be selectively adjusted to run on four, six or eight cylinders.

8 Claims, 6 Drawing Figures

CYLINDER DEACTIVATOR DEVICE FOR DIESEL ENGINES

This invention relates to new and useful improvements in cylinder deactivation devices for diesel engines.

In the interests of fuel economy, devices are known for use with gasoline powered engines, which enables the operator to deactivate certain cylinders of multi-cylinder engines when the vehicle is up to speed and full power is not required.

For example, U.S. Pat. No. 4,307,687 describes and illustrates a device which enables three cylinders of a six cylinder engine or four cylinders of an eight cylinder engine to be deactivated manually by the operator. This means that he can either run on eight cylinders (for start, traffic work, hill climbing or the like) or on four cylinders (when cruising on relatively flat high-ways and rapid acceleration is not required).

Other devices exist for use with gasoline powered engines which enable an eight cylinder engine to be operated as though only four, five, six or seven cylinders are operating. In all cases it should be appreciated that it is a carburetion-type engine that is being discussed insofar as gasoline operation is concerned.

With fuel injection engines, particularly diesel-type engines, different structure is required and the present device is designed specifically for use on the diesel engines which use a relatively high pressure injection pump although of course it will be appreciated that it can be adapted for use with gasoline operated fuel injection vehicles.

In accordance with the present invention, there is provided a cylindrical valve assembly operatively connected to the fuel injection pump and to the individual cylinders of a six or eight cylinder engine. When the valve is in the "open" position, fuel is injected into all of the cylinders in the conventional manner but when the valve is actuated so that part or all of same is in the "closed" position, then two or four of the cylinders are inactivated because the high pressure fuel being injected by the pump, is bypassed back to the reservoir.

The device is easily fitted to existing fuel lines and can be manually operated remotely so that, in an eight cylinder engine, either two or four cylinders may be inactivated or, in a six cylinder engine, one, two or three cylinders may be inactivated.

Another advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

BRIEF DESCRIPTION OF THE DRAWINGS

In the drawings like characters of reference indicate corresponding parts in the different figures.

DETAILED DESCRIPTION

Figure 1:
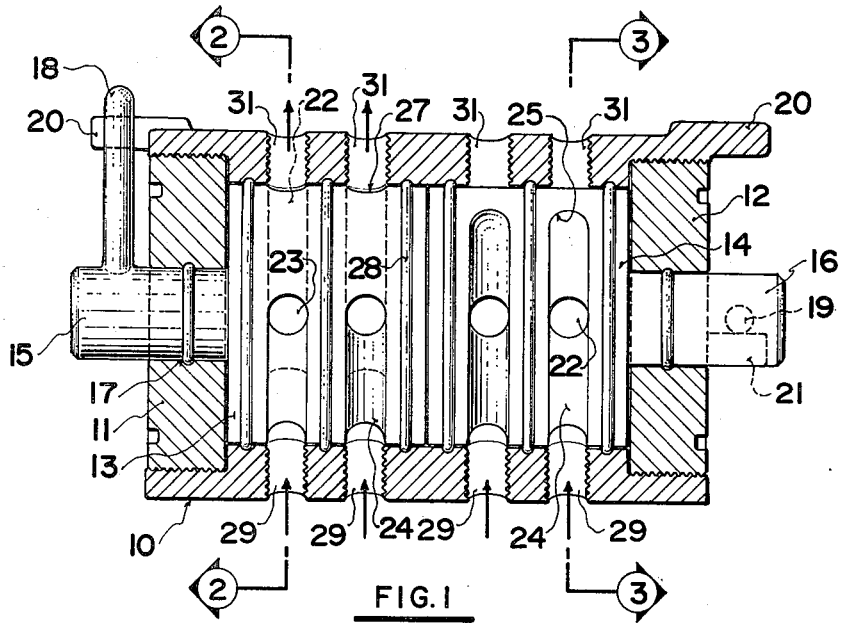
FIG. 1 is a longitudinal section of the rotary valve assembly showing one element in the "open" position and the other element in the "closed" position.

Proceeding therefore to describe the invention in detail, reference character 10 illustrates a hollow cylindrical or barrel shaped body having screw threaded end caps 11 and 12 screw threadably engaged within the screw threaded ends of the barrel, the internal diameter of which is enlarged at this point to receive same.

Two cylindrical valve elements 13 and 14 are engaged one from each end of the body 10 and the elements have a spindle 15 and 16 respectively extending outwardly and axially from the elements and bearingly engaging through the end caps 11 and 12 respectively with an O ring seal 17, or the equivalent being provided around the spindles and within the end caps to seal same.

Actuating levers 18 and 19 are secured to the spindles 15 and 16 respectively and may move through 90° movement independently of one another controlled by stops 20 and 21 extending from the ends of the body or barrel portion 10.

The two cylindrical valve elements 13 and 14 are similar in construction and both includes a pair of diametrically extending passageways 22 extending therethrough spaced and parallel to one another with a radial passageway 23 extending at right angles from the center of each diametrically extending passageway 22, through to the surface of the valve element.

A semi-annular groove 24 extends from the outer end of each radial passageway 23, through approximately 150° and terminating at a point 25 on the surface of the valve element. This semi-annular groove 24 passes and communicates with one end of the diametrically extending passageway 22.

A shorter semi-annular groove 26 extends from the other end of each of the diametrically extending passageways 22, to a point 27 and extends radially approximately 30° and this semi-annular groove 26 extends on the surface of the valve element, in a direction towards the end 25 of the radially extending passageway 23 as clearly shown in the drawings.

Sealing means such as O rings 28 are provided around the circumference of the valve elements 13 and 14 on either side of the annular grooves and passageways to isolate one from the other and to maintain a sealing relationship between the sections defined between adjacent O rings and the two valve elements butt against one another centrally of the cylindrical shell or casing 10 as clearly shown in FIG. 1.

A plurality of ports is provided through the wall of the casing or shell 10, there being one set of ports for each set of transfer channels and grooves. Each set of transfer channels and grooves include a diametrically extending passageway 22, an adjacent radially extending passage 23, and semi-annular grooves 24 and 26.

Each set of ports includes a screw threaded port 29 operatively connected to an injector pump 32, a screw threaded port 30 operatively connected to a reservoir (not illustrated) which feeds the injector pump, and a screw threaded outlet port 31 each connected to an individual cylinder of a six or eight cylinder engine. Reference character 32 illustrates schematically such an injector pump in FIG. 6, and reference characters 1 through 8 illustrates individual cylinders of an eight cylinder engine.

Figure 6:
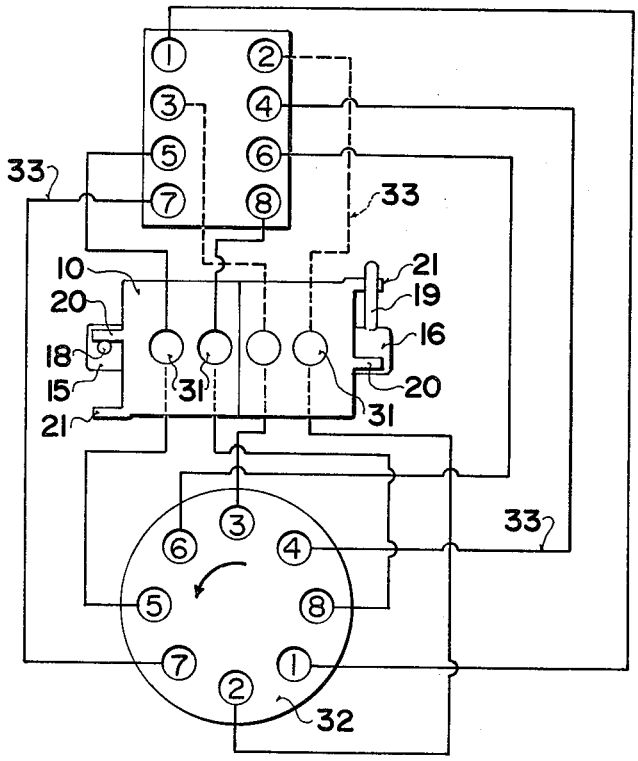
FIG. 6 is a schematic view showing the connection between the pump, the valve and the cylinder injectors of an eight cylinder engine.
Figure 2:
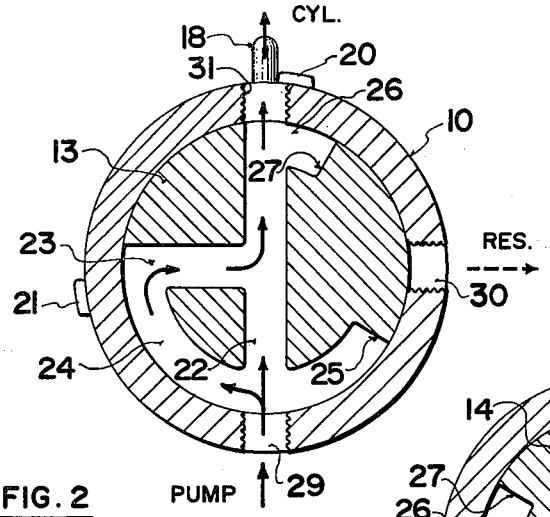
FIG. 2 is a vertical section along the line 2—2 of FIG. 1.

When the valve element is in the position illustrated in FIG. 2, there is a direct communication from the pump 32, through the diametrical passage 22 and through the port 31 to the cylinder via injection fuel line 33 (see FIG. 6). However, if one of the valve elements is turned to the position shown in FIG. 3, two of the fuel lines 33 operatively connecting to this particular valve element, are shutoff from the pump and instead the fuel is by-passed through the radially extending passageway 23, through part of the diametrically extending passageway 22 and through port 30 to the reservoir.

This means that under these circumstances, the engine is operating on six cylinders.

Figure 3:
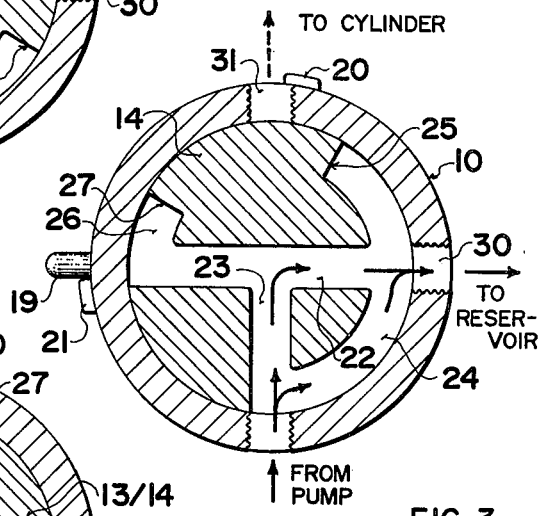
FIG. 3 is a vertical section along the line 3—3 of FIG. 1.

If both of the valve elements 13 and 14 are turned to the position shown in FIG. 3, then four of the cylinders in an eight cylinder engine are inactivated and the fuel from all of these four fuel lines is directed back to the reservoir.

If a six cylinder engine is being utilized, then one set of passageways and radial grooves of one valve element is not connected so that if this particular valve element is moved to the position shown in FIG. 3, then only one cylinder is cutoff and if the other is also moved to the position shown in FIG. 3 then three cylinders are cutoff.

It will be appreciated that fuel injection pumps, and particularly diesel fuel injection pumps operate under extremely high pressures of perhaps 2000 p.s.i. to 4000 p.s.i. with pressures at times reaching 20,000 p.s.i. if for example, a fuel injection jet becomes partially blocked. Because of the extreme pressures, injector pumps normally are direct pressure pumps with no safety valve provisions.

It will therefore be appreciated that it is necessary to ensure that the transition time from valve open to valve closed and vice versa be as short as possible and considering that the valve element may be moved rapidly or slowly, means are provided to reduce the transition time period to the absolute minimum. This is the reason for the semi-annular grooves 24 and 26 and in this connection reference should be made to FIGS. 4 and 5.

Figure 4:
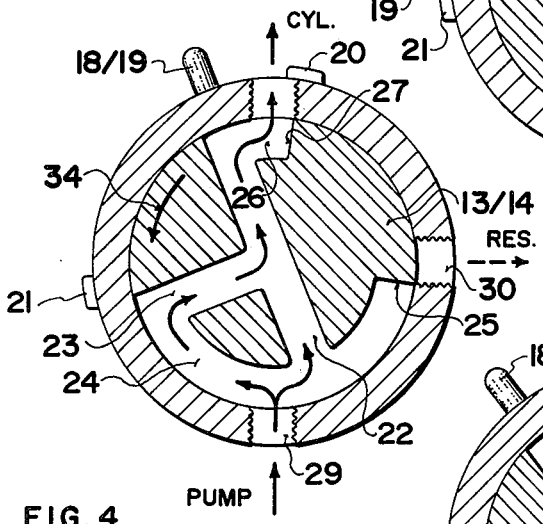
FIG. 4 is a vertical section showing one of the cylindrical elements moving towards the "closed" position.
Figure 5:
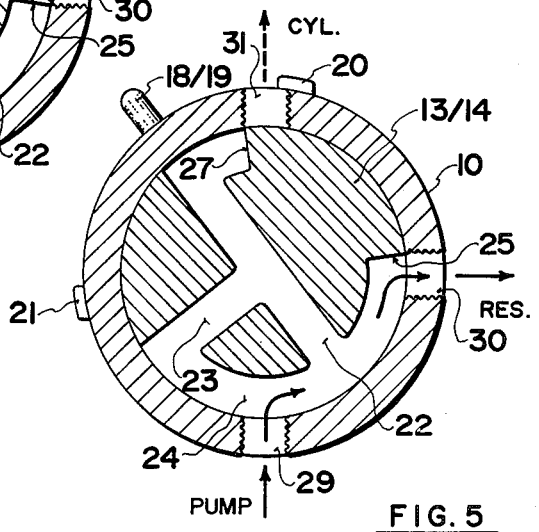
FIG. 5 is a view similar to FIG. 4 but showing the rotary element in the initial "closed" position.

If the valve element is being moved from the position shown in FIG. 2 to the position shown in FIG. 3, partial rotation of the element in the direction of arrow 34 will first move the element to the position shown in FIG. 4 where the end 27 of annular passageway 26 is adjacent to the port 31. It will also be observed that the end 25 of the semi-annular groove 24 is adjacent the reservoir port 30. Up until this point, fuel is passing from the pump port 29 through the groove 22 and out through the cylinder port 31 but a further relatively short movement of the element to the position shown in FIG. 5 gives an immediate transfer of the routing so that it travels from the cylinder port 29 through the semi-annular groove 24 and directly to the reservoir port 30, the transition period being the width of the ports so that this transition is practically instantaneous thus relieving excessive pressures from the pump 32.

By the same token, when the movement is reversed, the same action takes place with the changeover being extremely rapid.

If desired, a safety pressure control valve may be provided between the lines 33 and a reservoir set at a higher pressure than the normal operating pressure of the pump 32 so that if an injector valve becomes blocked, then this pressure relief valve will operate once again preventing damage from occurring to the pump.

FIG. 6 shows schematically, one example of the operation of this device. In the example illustrated, cylinders 1, 6, 4 and 7 are connected to the pump 32 by lines 33 and operate under all conditions.

Cylinders 2, 3, 5 and 8 extend from the pump 32 via the valve assembly, cylinders 2 and 3 extending via valve element 14 and cylinders 5 and 8 via valve element 13. In the position shown in FIG. 1, valve element 13 is open so that cylinders 5 and 8 are operative whereas valve element 14 is closed so that the cylinders 2 and 3 are inoperative. This means that the engine is operating on six of the eight cylinders.

If valve element 14 is moved to the "open" position similar to that shown in FIG. 2 then the engine will operate on all eight cylinders. Conversely if the valve element 13 is moved to the closed position as shown in FIG. 3 then cylinders 5 and 8 will become inoperative and the engine will operate on four cylinders. The above is exemplary only and of course other combinations can be chosen.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A cylinder deactivating device for use on diesel engines which include a fuel pump and fuel lines operatively connecting said fuel pump to each cylinder of the diesel engines; comprising in combination a rotary valve assembly operatively connected selectively to half of the cylinders of the engine, said rotary valve assembly including a cylindrical casing and at least one rotary valve element mounted for partial rotation within said casing, a set of ports in said casing for each cylinder connected to said rotary valve assembly and a set of fuel transfer channels in said rotary valve element for each cylinder connected to said rotary valve assembly, each set of ports including a port operatively connected to said fuel pump, a port operatively connected to said reservoir and a port operatively connected to one of the cylinders connected to said rotary valve assembly, said rotary valve element being movable from an inactive position connecting said fuel pump to said reservoir and an operative position connecting said fuel pump to the respective cylinders and vice versa, via the respective set of fuel transfer channels and said rotary valve element, each set of transfer channels including a first transfer channel extending diametrically through said rotary valve element and a second transfer channel extending radially through said rotary valve element from intermediate the ends of said first transfer channel to the surface of said rotary valve element, said first transfer channel operatively connecting said fuel pump port with said reservoir port being inactivated when said rotary valve element is in the operative position, said first transfer channel and said second transfer channel operatively connecting said fuel pump port with said cylinder port being inactive, when said rotary valve element is in the inactive position, means on said rotary valve element for reducing the angular movement of said rotary valve element from one position to the other, to the diameter of said ports, said means for reducing the angular movement of said rotary valve element including a first annular groove extending on one side of one outer end of said first transfer channel to the outer end of said second transfer channel and on the other side of said one outer end, a distance less than 90° from the longitudinal axis of said first transfer channel; and a second annular groove extending from the other end of said first transfer channel towards said other side of said first transfer channel and for a distance less than 45° from the longitudinal axis of said first transfer channel whereby when said rotary valve element is moved from the operative position towards the inactive position, the operative connection between the pump port and the cylinder port 1 is maintained until the distal edges of said first and second annular channels are adjacent said reservoir port and said cylinder port respectively; and when said rotary valve element is moved from the inactive position to the operative position, the connection between said pump and reservoir is maintained until the distal ends of said first and second annular grooves are adjacent the reservoir port and the cylinder port respectively.

2. The device according to claim 1, which include a pair of rotary valve elements mounted axially for rotation within said cylindrical casing, each rotary valve element being connected to half of the cylinders selectively and operatively connected to said rotary valve assembly, each rotary valve assembly including a set of ports and a set of transfer passageways for each cylinder connected to said individual rotary valve element and means to operate each rotary valve element selectively and independently from one another.

3. In combination, a cylinder deactivating device and a diesel engine which includes a fuel pump, and fuel lines operatively connecting said fuel pump to each cylinder thereof, said cylinder deactivating device including a rotary valve assembly operatively connected selectively to half of the cylinders of the engine, said rotary valve assembly including a cylindrical casing and at least one rotary valve element mounted for partial rotation within said casing, a set of ports in said casing for each cylinder connected to said rotary valve assembly and a set of fuel transfer channels in said rotary valve element for each cylinder connected to said rotary valve assembly, each set of ports including a port operatively connected to said fuel pump, a port operatively connected to said reservoir and a port operatively connected to one of the cylinders connected to said rotary valve assembly, said rotary valve element being movable from an inactive position connecting said fuel pump to said reservoir and an operative position connecting said fuel pump to the respective cylinders and vice versa, via the respective set of fuel transfer channels and said rotary valve element, each set of transfer channels including a first transfer channel extending diametrically through said rotary valve element and a second transfer channel extending radially through said rotary valve element from intermediate the ends of said first transfer channel to the surface of said rotary valve element, said first transfer channel operatively connecting said fuel pump port with said reservoir port being inactivated when said rotary valve element is in the operative position, said first transfer channel and said second transfer channel operatively connecting said fuel pump port with said cylinder port being inactive, when said rotary valve element is in the inactive position, means on said rotary valve element for reducing the angular movement of said rotary valve element from one position to the other, to the diameter of said ports, said means for reducing the angular movement of said rotary valve element including a first annular groove extending on one side of one outer end of said first transfer channel to the outer end of said second transfer channel and on the other side of said one outer end, a distance less than 90° from the longitudinal axis of said transfer channel; and a second annular groove extending from the other end of said first transfer channel towards said other side of said first transfer channel and for a distance less than 45° from the longitudinal axis of said first transfer channel whereby when said rotary valve element is moved from the operative position towards the inactive position, the operative connection between the pump port and the cylinder port is maintained until the distal edges of said first and second annular channels are adjacent said reservoir port and said cylinder port respectively; and when said rotary valve element is moved from the inactive position to the operative position, the connection between said pump and reservoir is maintained until the distal ends of said first and second annular grooves are adjacent the reservoir port and the cylinder port respectively.

4. The combination according to claim 3, which include a pair of rotary valve elements mounted axially for rotation within said cylindrical casing, each rotary valve element being connected to half of the cylinders selectively and operatively connected to said rotary valve assembly, each rotary valve assembly including a set of ports and a set of transfer passageways for each cylinder connected to said individual rotary valve element and means to operate each rotary valve element selectively and independently from one another.

5. A cylinder deactivating device for use on diesel engines which include a fuel pump and fuel lines operatively connecting said fuel pump to each cylinder of the diesel engines, comprising in combination a rotary valve assembly operatively connected selectively to half of the cylinders of the engine, said rotary valve assembly including a cylindrical casing and at least one rotary valve element mounted for partial rotation within said casing, a set of ports in said casing for each cylinder connected to said rotary valve assembly and a set of fuel transfer channels in said rotary valve element for each cylinder connected to said rotary valve assembly, each set of ports including a port operatively connected to said fuel pump, a port operatively connected to said reservoir and a port operatively connected to one of the cylinders connected to said rotary valve assembly, said rotary valve element being movable from an inactive position connecting said fuel pump to said reservoir and an operative position connecting said fuel pump to the respective cylinders and vice versa, via the respective set of fuel transfer channels and said rotary valve element, a pair of rotary valve elements mounted axially for rotation within said cylindrical casing, each rotary valve element being connected to half of the cylinders selectively and operatively connected to said rotary valve assembly, each rotary valve assembly including a set of ports and a set of transfer passageways for each cylinder connected to said individual rotary valve element and means to operate each rotary valve element selectively and independently from one another.

6. The device according to claim 5 which includes means on said rotary valve element for reducing the angular movement of said rotary valve element from one position to the other, to the diameter of said ports.

7. The device according to claim 5 in which said means for reducing the angular movement of said rotary valve element includes a first annular groove extending on one side of one outer end of said transfer channel to the outer end of said second transfer channel and on the other side of said one outer end, a distance less than 90° from the longitudinal axis of said first transfer channel; and a second annular groove extending from the other end of said first transfer channel towards said other side of said first transfer channel and for a distance less than 45° from the longitudinal axis of said first transfer channel whereby when said rotary valve element is moved from the operative position towards the inactive position, the operative connection between the pump port and the cylinder port is maintained until the distal edges of said first and second annular channels are adjacent said reservoir port and said cylinder port respectively; and when said rotary valve element is moved from the inactive position to the operative position, the connection between said pump and reservoir is maintained until the distal ends of said first and second annular grooves are adjacent the reservoir port and the cylinder port respectively.

8. The device according to claim 5 in which each set of transfer channels includes a first transfer channel extending diametrically through said rotary valve element and a second transfer channel extending radially through said rotary valve element from intermediate the ends of said first transfer channel to the surface of said rotary valve element, said first transfer channel operatively connecting said fuel pump port with said reservoir port being inactivated when said rotary valve element is in the operative position, said first transfer channel and said second transfer channel operatively connecting said fuel pump port with said cylinder port being inactive, when said rotary valve element is in the inactive position.

* * * * *